US007931566B1

(12) United States Patent
Radke et al.

(10) Patent No.: US 7,931,566 B1
(45) Date of Patent: Apr. 26, 2011

(54) EXERCISE APPARATUS BRAKE

(75) Inventors: Todd C. Radke, Lino Lakes, MN (US); Matthew A. Donner, Andover, MN (US); Jon A. Strommen, Ramsey, MN (US); Benjamin J. Hitter, Big Lake, MN (US); Nicholas T. Schaub, New Hope, MN (US); Peter H. Haugen, Eden Prairie, MN (US)

(73) Assignee: Brunswick Corporation, Lake Forest, IL (US)

( * ) Notice: Subject to any disclaimer, the term of this patent is extended or adjusted under 35 U.S.C. 154(b) by 80 days.

(21) Appl. No.: 12/367,041

(22) Filed: Feb. 6, 2009

(51) Int. Cl.
*A63B 22/00* (2006.01)
*A63B 69/18* (2006.01)

(52) U.S. Cl. ..... 482/51; 482/70

(58) Field of Classification Search ..... 482/51–52, 482/65, 66, 70, 139
See application file for complete search history.

(56) References Cited

U.S. PATENT DOCUMENTS

| | | | | |
|---|---|---|---|---|
| 4,023,795 | A * | 5/1977 | Pauls | 482/70 |
| 4,720,093 | A * | 1/1988 | Del Mar | 482/52 |
| 5,007,631 | A * | 4/1991 | Wang | 482/52 |
| 5,346,451 | A * | 9/1994 | Miller | 482/112 |
| 5,383,829 | A * | 1/1995 | Miller | 482/57 |
| 5,899,833 | A * | 5/1999 | Ryan et al. | 482/52 |
| 6,277,055 | B1 * | 8/2001 | Birrell et al. | 482/52 |
| 6,752,744 | B2 * | 6/2004 | Arnold et al. | 482/52 |
| 6,761,665 | B2 * | 7/2004 | Nguyen | 482/51 |
| 7,267,637 | B2 * | 9/2007 | Mercado et al. | 482/52 |
| 2005/0250621 | A1 * | 11/2005 | Corbalis et al. | 482/52 |
| 2006/0293154 | A1 * | 12/2006 | Graber | 482/52 |
| 2007/0111864 | A1 * | 5/2007 | Schmidt | 482/70 |

* cited by examiner

*Primary Examiner* — Loan Thanh
*Assistant Examiner* — Sundhara M Ganesan
(74) *Attorney, Agent, or Firm* — Andrus, Sceales, Starke and Sawall, LLP

(57) ABSTRACT

Exercise apparatus, which may be an elliptical cross trainer, has a rotating inertial flywheel driven by user-engaged linkage exercising a user. A user-actuated brake engages and stops rotation of the flywheel upon actuation by the user.

2 Claims, 2 Drawing Sheets

EXERCISE APPARATUS BRAKE

BACKGROUND AND SUMMARY

The invention relates to exercise apparatus, including elliptical cross trainers.

Exercise apparatus, including elliptical cross trainers, are known in the prior art. A user can have difficulty getting into exercise position on a cross trainer because the linkage moves freely. The user cannot restrict the pedal movement when the unit is not in use. It is known in the prior art to increase the resistance in an eddy current brake to the maximum when the unit is not in use. This makes the linkage difficult to move.

The present invention provides a simple and effective brake for exercise apparatus, including cross trainers.

DETAILED DESCRIPTION

Figure 1:
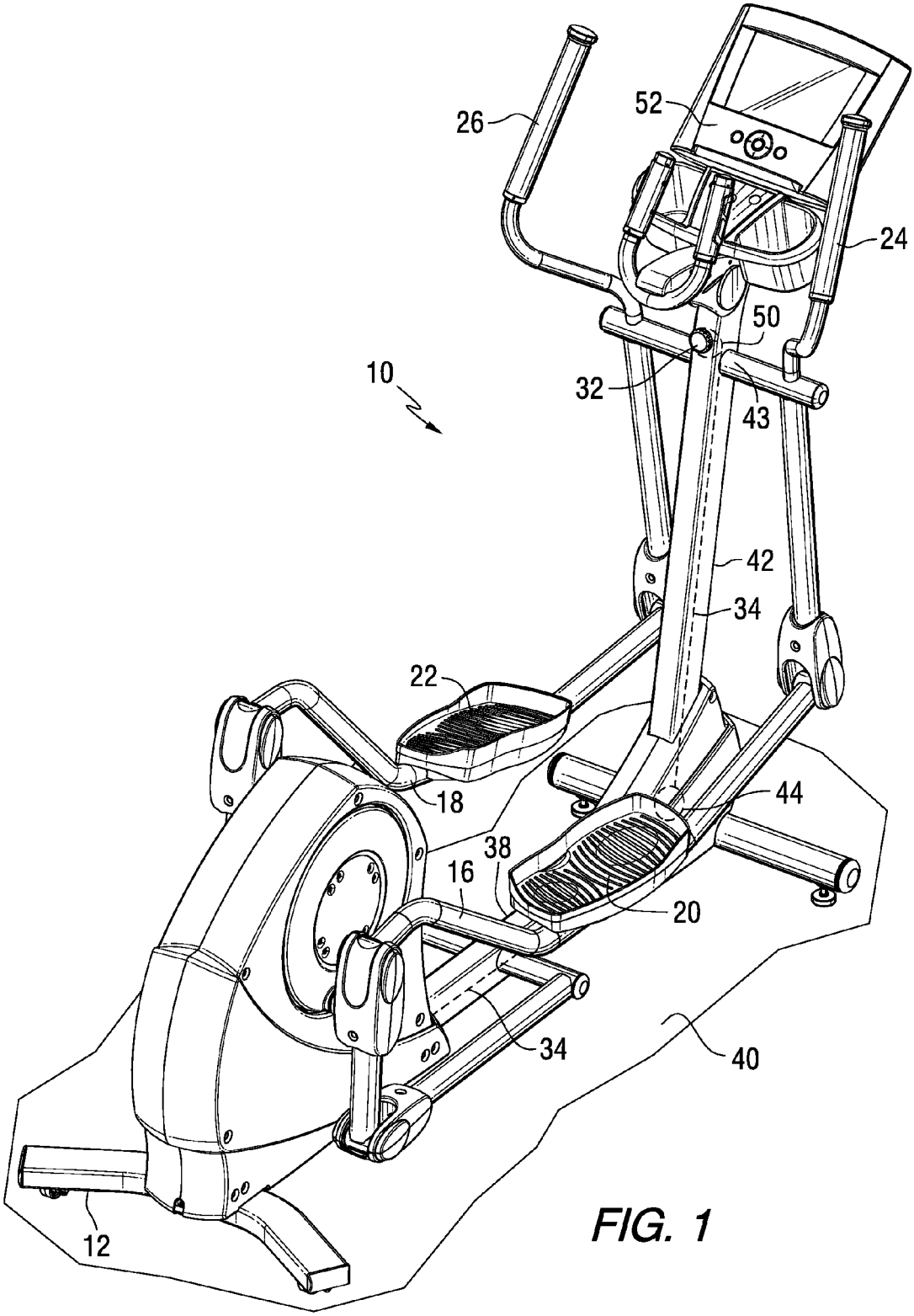
FIG. 1 is a perspective view of exercise apparatus having a brake in accordance with the invention.
Figure 2:
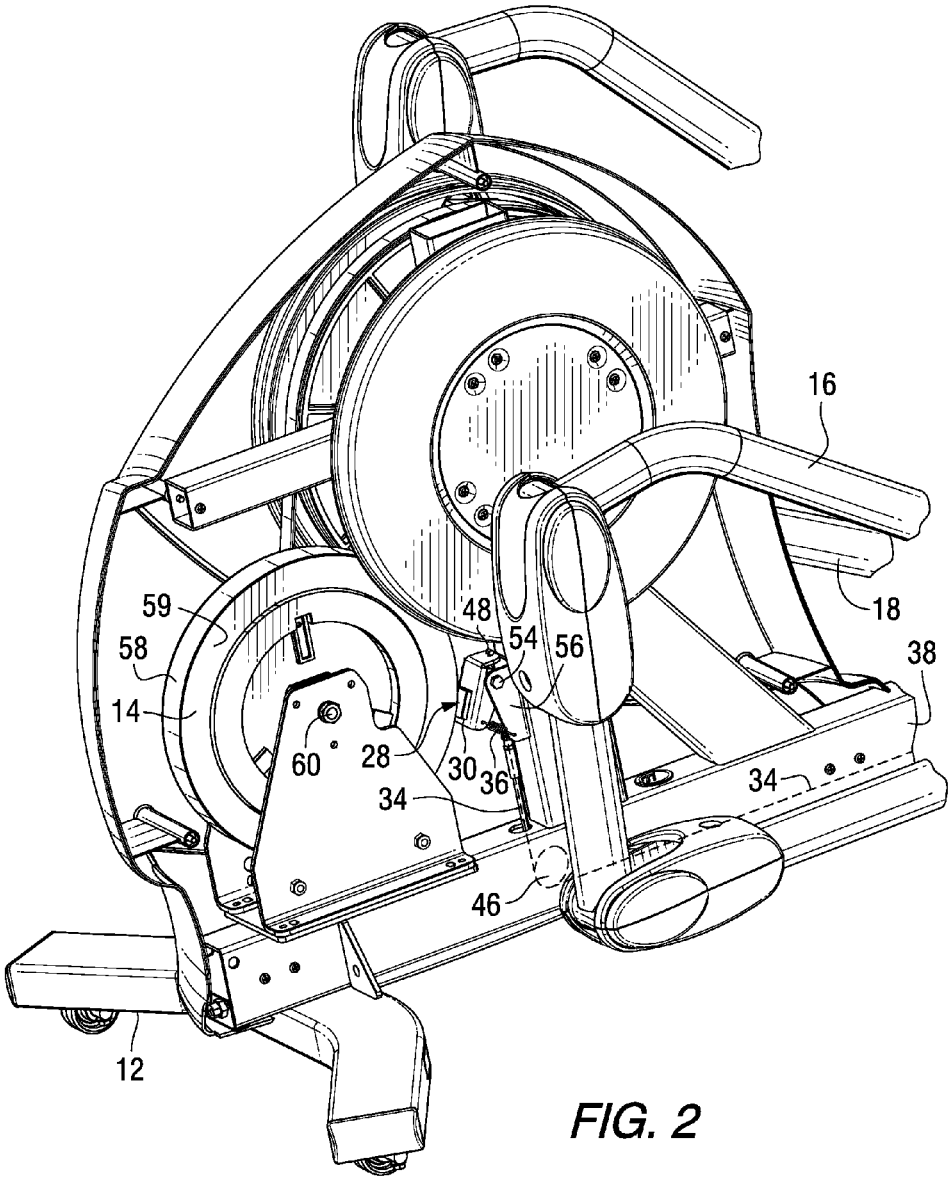
FIG. 2 is an enlarged view of a portion of FIG. 1 partially cut-away.

FIG. 1 shows exercise apparatus 10, which in one embodiment is an elliptical cross trainer, including a frame 12 having a rotating inertial flywheel 14, FIG. 2, driven by user-engaged linkage 16, 18 exercising a user, e.g. standing on foot pads 20, 22 and holding handles 24, 26, as is known. In the present system, a user-actuated brake 28 engages and stops rotation of flywheel 14 upon actuation by the user. The brake has an actuated condition engaging the flywheel and maintaining the flywheel and the linkage stationary during mounting and de-mounting of the apparatus by the user. The brake is provided by a flywheel-engagement-member 30 movably mounted to the frame and movable between a braking position frictionally engaging and stopping rotation of the flywheel, and a release position disengaging the flywheel and permitting rotation thereof as driven by linkage 16, 18.

A user-engageable actuator 32 is operatively coupled to flywheel-engagement-member 30 and is operable by the user to actuate the flywheel-engagement-member 30 between the noted braking and release positions. In one embodiment, the user-engageable actuator is operatively coupled to the flywheel-engagement-member by a mechanical cable 34. The cable pulls flywheel-engagement-member 30 in a first direction to move from the release position toward flywheel 14 to the braking position. A biasing member, e.g. tension spring 36, biases flywheel-engagement-member 30 in a second direction to move from the braking position away from flywheel 14 to the noted release position.

Frame 12 includes a lower horizontal base 38 extending back to front along a floor 40 supporting the apparatus. A forward post 42 extends upwardly from the front of base 38 and has an upper segment 43 approximate the user's hands when in exercise position. Flywheel 14 is at the back of base 38 and is proximate the user's feet when in exercise position. Cable 34 runs from the upper segment 43 of forward post 42 than downwardly therein, as shown in dashed line, along the forward post then around an internal pulley 44 than aft along base 38, as shown in dashed line, then around internal pulley 46, then upwardly as shown in FIG. 2 and is attached to the brake at attachment point 48. Flywheel-engagement-member 30 is at the back of base 38. User-engageable actuator 32 is at the upper segment 43 of forward post 42. Actuator 32 may be a rotational knob having an inner wheel as shown in dashed line at 50 which pulls cable 34 in one direction of rotation of the knob, and releases the cable in the other direction of rotation of the knob. In other embodiments, other mechanical devices can be used for actuating the cable, e.g. a lever, or the cable may be actuated electrically at console 52, or in other manners.

Flywheel-engagement-member 30 is pivotally mounted to the frame at trunnion or axle or bolt 54 at bracket 56, and pivots between the noted braking and release positions into and out of frictional engagement with flywheel 14 at the outer radially outwardly facing surface 58 thereof. In an alternative, the axially facing side surfaces such as 59 of the flywheel may be frictionally engaged by the brake pad. Flywheel 14 rotates about a rotation axis along axle 60. Flywheel-engagement-member 30 pivots about a pivot axis along trunnion 54. The rotation axis along 60 is parallel to the pivot axis along 54. Cable 34 extends along an extension direction from attachment point 48, e.g. in the orientation of FIG. 2 the cable 34 extends downwardly from attachment point 48. Cable 34 along the noted extension direction is spaced and separated from pivot axis 54 along a first spatial direction, e.g. forwardly therefrom, which is rightwardly in the orientation of FIG. 2. Flywheel 14 is spaced and separated from pivot axis 54 along a second spatial direction, e.g. aft therefrom, which is leftwardly in the orientation of FIG. 2. The noted second spatial direction is opposite to the noted first spatial direction. The noted extension direction of cable 34 from attachment point 48 is perpendicular to the noted pivot axis 54 and to the noted rotation axis 60.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. The invention is particularly useful in conjunction with an elliptical cross trainer, as disclosed, but has broader application to and may be used in conjunction with other exercise apparatus having a rotating inertial flywheel.

What is claimed is:

1. Exercise apparatus comprising a frame having a rotating inertial flywheel driven by user-engaged linkage exercising a user, a user actuated brake engaging and stopping rotation of said flywheel upon actuation by said user, wherein:

said brake comprises a flywheel-engagement-member movably mounted to said frame and movable between a braking position frictionally engaging and stopping rotation of said flywheel, and a release position disengaging said flywheel and permitting rotation thereof as driven by said linkage;

said flywheel-engagement-member is pivotally mounted to said frame and pivots between said braking and release positions into and out of frictional engagement with said flywheel;

said flywheel rotates about a rotation axis;

said flywheel-engagement-member pivots about a pivot axis;

said rotation axis is parallel to said pivot axis;

a user-engageable actuator is operatively coupled to said flywheel-engagement-member and operable by said user to actuate said flywheel-engagement-member between said braking and release positions;

said user-engageable actuator is operatively coupled to said flywheel-engagement-member by a mechanical cable attached to said flywheel-engagement-member at an attachment point;

said cable extends along an extension direction from said attachment point;

said extension direction is perpendicular to said pivot axis and to said rotation axis;

said cable extending along said extension direction is spaced and separated from said pivot axis along a first spatial direction;

said flywheel is spaced and separated from said pivot axis along a second spatial direction opposite to said first spatial direction;

said flywheel-engagement member in said release position is spaced from said pivot axis along said extension direction.

2. Exercise apparatus comprising a frame having a rotating inertial flywheel driven by user-engaged linkage exercising a user, a user actuated brake engaging and stopping rotation of said flywheel upon actuation by said user, said brake having an actuated condition engaging said flywheel and maintaining said flywheel and said linkage stationary during mounting and de-mounting of said apparatus by said user, said brake comprising a flywheel-engagement-member movably mounted to said frame and movable between a braking position frictionally engaging and stopping rotation of said flywheel, and a release position disengaging said flywheel and permitting rotation thereof as driven by said linkage, a user-engageable actuator operatively coupled to said flywheel-engagement-member and operable by said user to actuate said flywheel-engagement-member between said braking and release positions, said user-engageable actuator being operatively coupled to said flywheel-engagement-member by a mechanical cable, said cable pulling said flywheel-engagement-member in a first direction to move from said release position toward said flywheel to said braking position, wherein:

said flywheel-engagement-member is pivotally mounted to said frame and pivots between said braking and release positions into and out of frictional engagement with said flywheel;

said flywheel rotates about a rotation axis;

said flywheel-engagement-member pivots about a pivot axis;

said rotation axis is parallel to said pivot axis;

said cable engages said flywheel-engagement-member at an engagement point and extends along an extension direction therefrom;

said extension direction is perpendicular to said pivot axis and to said rotation axis;

said flywheel-engagement-member in said release position is spaced from said pivot axis along said extension direction.

* * * * *